United States Patent [19]

Kerlin et al.

[11] 4,277,279

[45] Jul. 7, 1981

[54] METHOD AND APPARATUS FOR DISPENSING A FLUIDIZED STREAM OF PARTICULATE MATERIAL

[75] Inventors: Richard G. Kerlin, Aliquippa; Henry T. Kossler; Peter J. Koros, both of Pittsburgh, all of Pa.; Robert G. Petrushka, Parma, Ohio

[73] Assignee: Jones & Laughlin Steel Corporation, Pittsburgh, Pa.

[21] Appl. No.: 132,968

[22] Filed: Mar. 24, 1980

[51] Int. Cl.[3] ..... C21C 7/02

[52] U.S. Cl. ..... 75/58; 75/53; 266/265

[58] Field of Search ..... 75/53, 58; 266/265–267

[56] References Cited

U.S. PATENT DOCUMENTS

| | | | |
|---|---|---|---|
| 3,929,464 | 12/1975 | Todd | 75/53 |
| 3,955,966 | 5/1976 | Meichsner | 75/58 |
| 3,998,625 | 12/1976 | Koros | 75/53 |

*Primary Examiner*—P. D. Rosenberg
*Attorney, Agent, or Firm*—John Stelmah

[57] ABSTRACT

Method and apparatus for dispensing a fluidized stream of particulate material, particularly a blended mixture of particulate materials which are useful in the desulfurization of molten ferrous metals. Control of the flow rates of the particulate materials are individually and independently controlled and without reliance upon varying the top pressures within the dispenser vessels containing the separate particulate materials.

20 Claims, 3 Drawing Figures

METHOD AND APPARATUS FOR DISPENSING A FLUIDIZED STREAM OF PARTICULATE MATERIAL

BACKGROUND OF THE INVENTION

1. Field of the Invention

This invention relates to method and apparatus for dispensing a fluidized stream of particulate material and more particularly a blended mixture of particulate materials, which mixture is formed during transport in a line extending to the receiving vessel. The invention more specifically relates to method and apparatus for controlling mixing and dispensing of desulfurizing agents for the desulfurization of molten ferrous metals.

2. Description of the Prior Art

This invention is an improvement of the invention disclosed and claimed in U.S. Pat. No. 3,998,625, which is owned by the assignee of this invention and which is incorporated by reference herein.

U.S. Pat. No. 3,998,625 discloses a desulfurization process in which a particulate non-oxidizing material such as lime and particulate magnesium-containing material are separately fed from their respective storage means to form a fluidized mixture in a non-oxidizing carrier gas and this mixture is injected into a molten ferrous metal. The magnesium component of the injected mixture serves as a potent desulfurization agent in the ferrous metal. A principal advantage of the process taught in U.S. Pat. No. 3,998,625 is that the injection rate of magnesium-containing material may be varied during the injection period to take into account process variables such as the fact that the efficiency of magnesium desulfurization decreases as the sulfur content of the bath decreases.

U.S. Pat. No. 3,807,602 describes a process for dispensing a fluidizable solid from the lower portion of a pressure vessel equipped with a weighing device, a closable supply, a discharge, and a source of three gas flows; a first of which is applied within the vessel at a level above the solid to be fluidized; a second of which is applied within the vessel in a lower portion thereof; and a third of which is applied within the discharge orifice of the vessel. A control device is associated with the weighing device which compares the actual value given by the weighing device with a desired value and in accordance with the result regulates the pressure of the above described first gas flow.

A major problem which has confronted the art in this field has been the inability to keep the particulate materials flowing through the transport lines in positive even flow when variations in gas flow pressures are encountered. It is difficult to maintain a constant even pressure in the fluidized stream of gas flow when the source of gas flow is being used to supply a gas flow to more than one dispensing unit or hopper and/or to more than one type of unit or line. The problem of maintaining desired gas flow pressures in a single dispensing unit is very complex. Hence, it will be appreciated that the problem of maintaining desired gas flow pressures in a plurality of gas flow lines amongst multiple dispensing hopper vessels feeding into a common transport line may be compounded at least exponentially. It should be recognized that in a dispensing unit there will occur, unless otherwise compensated for, a gradually decreasing flow resulting from the automatic reduction of the top space pressure in the hopper resulting from the reduction in the material volume and weight and from the increase in gas volume. In dispensing units, such as disclosed in the above referenced U.S. Pat. Nos. 3,998,625 and 3,807,602, which rely upon a separate gas flow to the top of a dispensing unit or hopper above the level of the material in the hopper to maintain positive flow of the material and upon regulation of the pressure of such separate gas flow, the pressure regulators are generally in constant operation in an attempt to adjust for the change in gas flow pressure caused by the material volume change. A concomitant problem with operator attendant controlled processes is one of time, i.e., the desulfurizing time cycle is very often completed before the pressures of the fluidized streams can be brought into proper balance, even by a highly skilled operator.

With this background, the present invention was conceived to overcome the undesirable effects of variations in pressures with the subsequent disruption of the smooth flow of particulate material, e.g., desulfurizing agents, from dispensing units through a transport line, and more particularly to overcome the undesirable effects of variations in gas flow pressures amongst a plurality of desulfurizing agent dispensers feeding into a common transport line for in-line mixing and subsequent feeding to a vessel containing molten ferrous metal.

SUMMARY OF THE INVENTION

The present invention provides method and apparatus for overcoming the problems associated with variations in carrier gas flow pressures in fluidized particulate material dispensing systems. The invention is particularly effective in conjunction with systems for dispensing desulfurizing agents in the desulfurization of molten ferrous metals and will therefore be described in conjunction therewith.

The present invention was conceived for use in a process such as described in U.S. Pat. No. 3,998,625 where a fluidized mixture of particulate materials is formed in a non-oxidizing carrier gas flow line and subsequently injected beneath the surface of a sulfur bearing molten ferrous metal contained in a refractory-lined vessel. Initially, the invention was tried in conjunction with a two dispenser system for in-line mixing of lime and magnesium powders. Subsequently, it was tried with a three dispenser system wherein one of the dispensers was used only on a stand-by basis. Occasionally, a batch of lime is found to be lacking in desirable flow characteristics and it becomes necessary to abort that particular batch. In such event, the provision of a stand-by supply conserves considerable amounts of time and materials. Additionally, it is easy to switch from one batch to the other batch with a minimum amount of adjustment to attain and maintain the desired flow rates in the flow passages; this is something which could not be done within the available time frame with top pressure regulatable systems.

Later the invention was expanded for use in a three dispenser system wherein three different powders are mixed in-line, e.g., lime, magnesium, and a flow enhancing or stabilizing powder such as graphite.

The present invention provides method and apparatus for in-line mixing of fluidized particulate materials from a plurality of vessels without relying upon the need for a separate gas flow to each of the vessels above the level of the material to be fluidized. Hence, this invention does not rely upon the regulation of such top pressure to facilitate dispensing of the materials. The invention also provides method and apparatus whereby the injection rate of a desulfurizing agent may be purposely and controllably varied and/or the ingredients of a desulfurizing agent mixture may be controllably varied, without interruption of the process, during a desulfurizing cycle.

To carry out the method according to the invention there is provided a transport line leading from one or more vessels or hoppers holding fluidizable particulate material, preferably in pulverulent form, each of the vessels having a transducer for transmitting a signal, which signal is indicative of the weight and/or the rate of flow of the particulate material in the corresponding vessel; an opening through which the material may be charged; a source of fluidizing gas for fluidizing the particulate material within the vessel; a passage leading from the vessel to the transport line; and regulatable means for varying a cross-sectional portion of the flow passage leading to the transport line and thereby control the flow rate of the material from the respective vessel.

In a preferred embodiment of the apparatus the regulatable means for varying a cross-sectional portion of a flow passage is in the form of a valve having a resilient sleeve body portion within the valve housing, wherein fluid pressure in the space between the housing and resilient sleeve opens, closes or throttles the valve.

DESCRIPTION OF PRIOR ART

Figure 1:
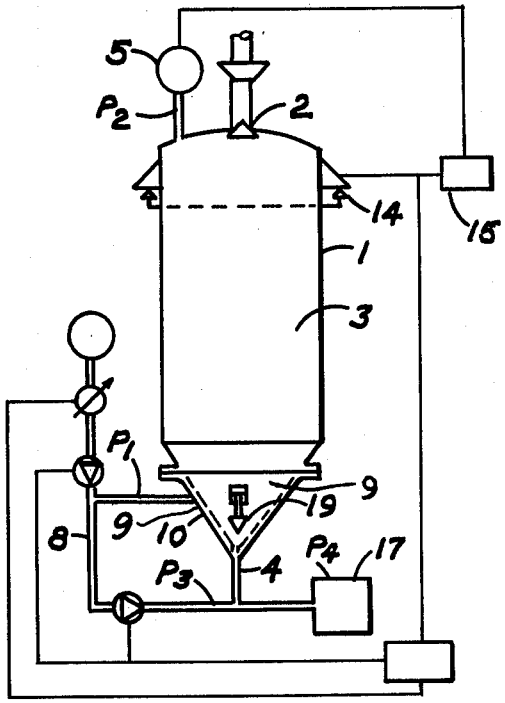
Fig. 1 PRIOR ART
FIG. 1 is a diagrammatic view of prior art operations such as disclosed in U.S. Pat. No. 3,807,602.

In prior known apparatus (as exemplified by U.S. Pat. No. 3,807,602) shown in FIG. 1, such apparatus includes a pressure vessel 1 with a closable charging aperture 2 and a discharge 4, closable by a plug 19 for the solid 3. A double-walled bottom 10 is provided for fluidization. A first gas pressure supply 5 under a pressure $P_2$ opens into the top of vessel 1. A second gas pressure supply at pressure $P_1$ opens into chamber 9. A third gas pressure supply 8 opens into discharge 4 at the pressure $P_3$. A conduit leads from the discharge 4 to chamber 17 which is at pressure $P_4$. A weighing device 14 is provided for metering the quantity of solid dispensed at vessel 1. A control device 15 compares the actual value given by weighing device 14 with a desired value and if the actual value does not correspond to the preset desired value the pressure $P_2$ of the first gas supply is adjusted.

DETAILED DESCRIPTION OF SPECIFIC EMBODIMENTS

The invention is particularly adapted for use in conjunction with a plurality of dispensing vessels feeding into a common transport line and for overcoming the attendant problems and hence will be described in that connection. However, it will be understood that some of the concepts disclosed herein may also apply to the dispensing of particulate material from a single dispensing vessel.

Figure 2:
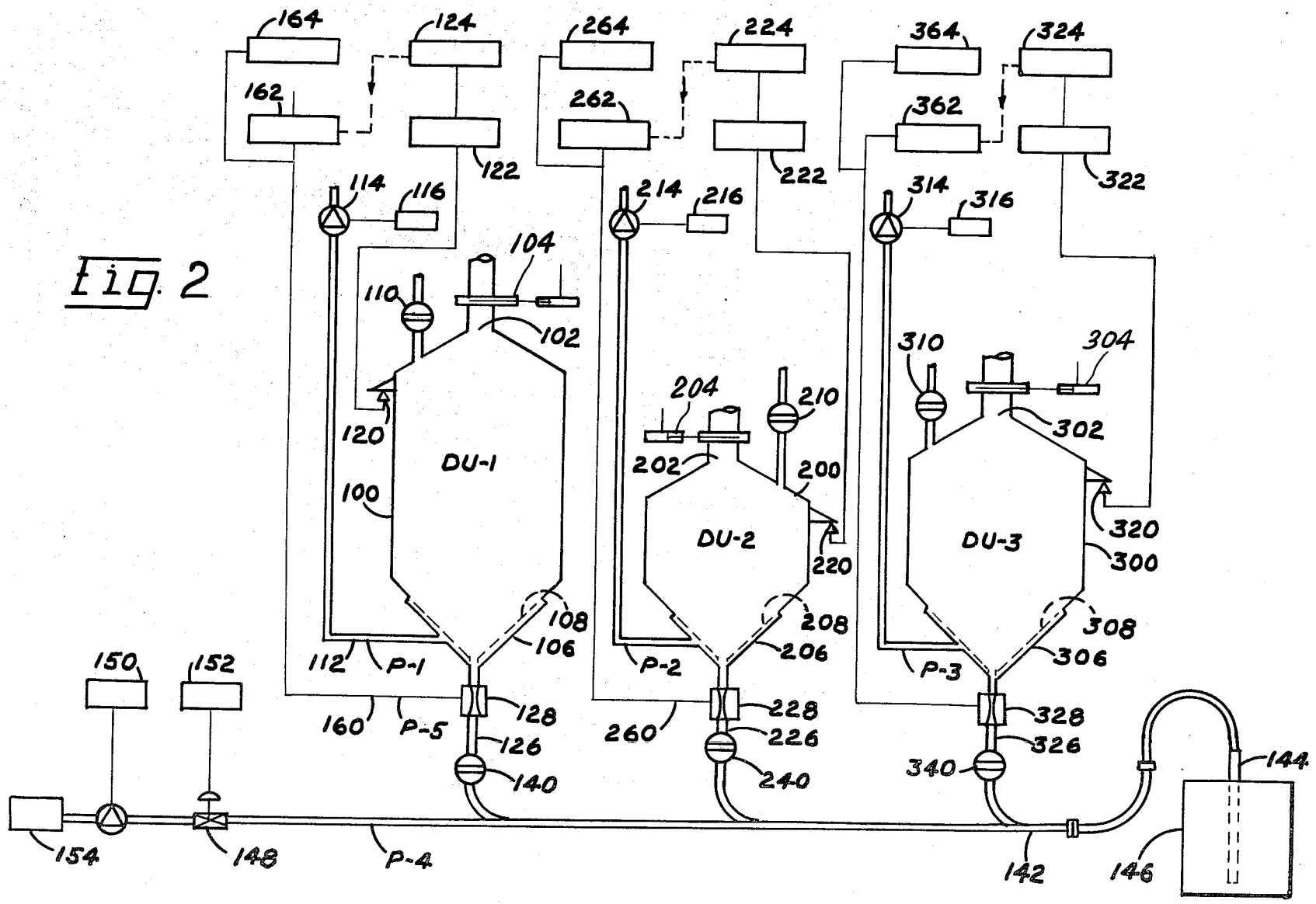
FIG. 2 is a schematic view of the apparatus forming a part of the present invention.

In FIG. 2 the three holding vessels which dispense particulate material are designated by the reference numerals 100; 200; and 300. Other elements employed in conjunction with a particular vessel bear reference numerals in the same series, i.e., all elements used in conjunction with vessel 100 bears numerals in the 100 series and corresponding elements used in conjunction with the other vessels bear the same last two digits in the respective reference numerals series.

The apparatus of this invention incorporates many of components of the known apparatus described above. However, there are important distinctions in the arrangement of certain components, the omission of others, and the inclusion of different types of others, which when combined provided a new and different mode of operation.

The apparatus includes one or more of the holding vessels 100; 200; and 300; for dispensing particulate fluidizable materials. Appropriate valves and controls are provided for use in conjunction with each of the vessels to form therewith apparatus which for convenience may be designated as a dispensing unit DU. The dispensing units DU-1; DU-2; and DU-3, correspond respectively to vessels 100; 200; and 300. Since the components of each of the dispensing units may correspond to and are illustrated as being the same as those of the other dispensing units, the details of only unit 100 will now be described.

The holding vessel 100 includes a fill port 102 through which particulate material may be introduced. A positionable valve 104 is provided to selectively close off port 102. Like previous devices, the vessel 100 may be provided with a double-wall bottom 106 which includes a fluid pervious wall 108 through which fluid may pass for fluidizing the particulate material in the vessel 100. A vent valve 110 is provided to enable selective venting of the internal fluid pressure within the vessel 100. A fluid pressure supply 112 at controllable pressure P-1 leads to the vessel 100 through bottom wall 106 for fluidization of the particulate material and providing internal pressure to the vessel 100. It should be particularly noted at this point that no separate source of fluid pressure supply is required to provide internal vessel pressure as is required in known prior devices. A positionable valve 114 and pressure control 116 are provided to control the flow and pressure of the fluid pressure supply 112.

A transducer 120 is provided in operative relation with vessel 100 to provide a signal to weigh monitoring device 122 which may provide an indication of the rate of weight change and/or the weight of the particulate material of vessel 100. The signal sensed by the weigh monitoring device may be used to provide a visual indication to the attendant operator who may compare the actual value indicated with a desired value and accordingly make an adjustment, in a manner hereinafter described, without substantially changing the fluid pressure within the vessel 100. The weight monitor 122 may be used in association with control 124 to make a similar adjustment. The avoidance of any substantial change in the fluid pressure in the vessel 100 avoids the use of and the concomitant disadvantages of adjusting the fluid pressure in order to attain control of the flow rate as described above.

Figure 3:
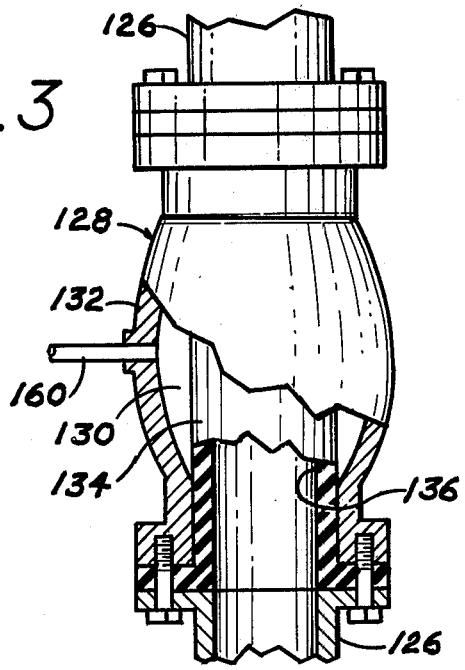
FIG. 3 is a cross-sectional view of a preferred form of valve for controlling the flow rate of material from a hopper to a transport line.

There is provided in conjunction with passage 126 which extends from vessel 100 a regulatable valve 128 which provides variable orifice means for varying a cross-sectional area portion of passage 126 and for thereby controlling the flow rate of the particulate material and pressure fluid from vessel 100 without the need for changing the pressure of the pressure fluid. Although a manually operated gate valve may be employed as the regulatable valve 128, in a preferred embodiment a resilient sleeve type valve such as illustrated in more detail in FIG. 3 is employed. In the valve 128 there illustrated an annular space 130 is defined between the housing 132 and the resilient sleeve 34. The sleeve 134 responses to fluid pressure in the annular space to open, close, or throttle the valve opening. Such a valve is preferred because in any throttled position a smooth bore 136 is defined which deters interruption of material flow due to material hanging up in and/or bridging the passage bore. An on-off type valve 140 may also be provided for passage 126 to facilitate start-up of the dispensing process.

As previously indicated the details of dispensing units DU-2 and DU-3 correspond to those of unit DU-1 and hence need no further description except to point out that all three units feed to common transport line 142 which in turn may feed to injection lance 144 positionable in a molten metal bath of container 146. The transport line 142 is provided with a transport gas flow control valve 148, pressure regulator 150, set point flow controller 152 for control valve 148, and a transport gas supply 154.

An advantage taught in U.S. Pat. No. 3,998,625 is of being able to vary the injection rate of lime-magnesium agent during a desulfurizing cycle in order to take account of the fact that the efficiency of magnesium desulfurization decreases as the sulfur content of the bath decreases.

Among the advantages of the present invention are (1) being able to vary the lime-magnesium agent in a more efficient manner and less chance of undesirable inerruptions, and (2) being able to vary the type of and/or the constituents of the desulfurizing agent during the injection period to effect savings in time and also in cost of desulfurizing agents.

An exemplary process practiced by the present invention will now be described in conjunction with the use of lime, graphite, and magnesium as the particulate materials used in a desulfurizing process. However, it will be understood that the invention may be used with other processes wherein in-line mixing of fluidizable particulate material is desired.

Lime is fed into vessel 100 through fill port 102. Vent valve 110 and valve 104 are then closed and the dispenser unit DU-1 is pressurized to pressure P-1 by a fluidization and pressure gas supply 112. In like manner, vessels 200 and 300 are charged with graphite and magnesium, respectively, and pressurized to pressures P-2 and P-3, respectively. The transport gas in transport line 142 is provided and essentially maintained at a preselected pressure P-4. During the desulfurizing process the transport line pressure and the dispensing vessel pressures are maintained in a relationship wherein each of the vessel pressures is greater than the transport line pressure P-4 and the pressure of each successive downstream vessel is greater than that of the next upstream vessel, i.e., P-3>P-2>P-1>P-4.

The open-close valve 140 which was in a closed position is now opened and valve 128 is then opened from a fully closed position to a position where the desired lime flow is attained as indicated by weight monitor 122. The lance 144 is then immersed in the molten metal of container 146. At this stage, because of the pressure of the molten bath exerted on the discharge port of the lance, some adjustment of the lime flow may be required and this can be accomplished by adjusting the size of the orifice opening in valve 128.

After the desired lime flow rate is established, the dispensing of the magnesium and the graphite materials is controlled by suitably adjusting the position of valves 228 and 328, respectively.

As previously indicated, a preferred embodiment of this invention includes the use of a valve such as illustrated in FIG. 3 for controlling the flow rate from a dispensing unit to the transport line. Such valves are less subject to plugging up but also provide means for more finite positioning and hence more finite control than that available with gate type valves. As shown in FIG. 3, the valve 128 is actuated by fluid pressure P-5 which may be from either gas or liquid sources through line 160. Pressure control valve 162 and pressure relief valve 164 are provided in line 160 to cooperate with valve 128 for control of the flow of the lime to transport line 142 in the manner described above. The function of relief valve 164 is to provide means for clearing valve 128 in the event any obstruction takes place. In such event the operator can open the relief valve 164 to relieve the pressure on the resilient sleeve and thereby permit the valve 128 to become fully open. Once the obstruction is removed, the pressure P-5 can be immediately restored to its previous value and the orifice opening to its previous cross-sectional area. In similar fashion the discharge of particulates from dispensing units DU-2 and DU-3 are controlled by adjusting their respective control valves 228 and 328.

The invention is particularly adapted for use in conjunction with desulfurizing systems wherein multiple desulfurizing agents are employed and more particularly wherein different flow rates are employed for each different agent, and/or during different times of the desulfurizing cycle.

According to one of the aspects of the present invention, there is provided a plurality (in excess of two) of dispensers of particular material. The particulate material may be desulfurizing agents, flow-aid agents, and/or other materials to be injected into a bath of molten metal. The dispensers are arranged in a manner whereby the various materials may be mixed in-line and as a result attain better and more homogenous mixtures than those generally provided with dispensers of premixed materials. Furthermore, flow-aids may be selectively introduced into the line when considered to be needed. Still further, the present invention may be employed to provide a standby source of particulate material which may be injected into the system without need to stop the desulurizing process in the event the material from the primary source is found to be defective or unsuitable. Additionally, the system of this invention may be employed to expeditiously change the flow rate of one or more of the materials being dispensed during the desulfurizing of a single batch of molten metal without adversely affecting or need to vary the fluid pressures in the dispensers.

An example of a type of desulfurizing processing that has been conducted by method and apparatus of this invention, which processing could not be consistently carried out effectively by known prior art practices, is that of two step blowing of desulfurizing agents involving at least three different ingredients which are not premixed.

We have discovered that considerable time and particulate material cost can be saved in a two-step desulfurizing method involving a lime-magnesium combination during the first step and a lime-graphite combination during the second step as compared to a single step method using a lime-grahite combination throughout as the following table illustrates.

| Method | $S_{Initial}$ | $S_{Final}$ | Time/ min. | Lime/ lbs. | Graphite | Mag. |
|---|---|---|---|---|---|---|
| One-step | .074 | .019 | 41 | 3700 | 250 | — |
| Two-step | | | | | | |
| (a) | .074 | .024 | 14 | 1350 | — | 260 |
| (b) | .025 | .014 | 15 | 1600 | 40 | — |
| | | | 29 | 2950 | | |
| Difference | | −.005 | −12 | −770 | −210 | +260 |

One of the main reasons such two-step method could not be effectively conducted previously is that there was not available effective means for balancing the ever changing vessel pressures in top vessel control systems within the time available during an injection cycle and the problem would be further compounded if an attempt were made to switch from one vessel source to another.

We have found that with the use of the two-step method as described above a savings of almost two dollars per net ton of hot metal can be realized when compared with the cost of using the one-step method. It will be recognized that this represents a substantial savings when viewed in the light of the fact that a typical torpedo car vessel in which the desulfurizing process is conducted will contain 160 tons of hot metal.

We have further noted that in the above referred to prior art processes uncontrolled surges in the feeding of magnesium during the desulfurizing cycle result in poor efficiences and non-uniformity in the product cast from the molten metal.

We have also found that with the apparatus of this invention the flow rates of one or more of the particulate materials used as desulfurizing agents may be expeditiously changed to provide different ratios of the materials during the desulfurizing cycle. As an example, we were able to conduct a three-step lime-magnesium desulfurizing cycle, in less than thirty-three minutes total time, a feat which was virtually impossible with prior art apparatus which rely upon top fluid pressure control within the container vessels. The results are shown in the following table.

| Step | $S_{Initial}$ | $S_{Final}$ | Time/ mins | Lime#/ min | Mg#/min | Lime/Mg |
|---|---|---|---|---|---|---|
| I | .060 | .047 | 7.3 | 184.9 | 10.8 | 17.1 |
| II | .047 | .019 | 10.2 | 142.2 | 9.6 | 14.8 |
| III | .019 | .005 | 15.1 | 124.2 | 7.8 | 15.9 |

What is claimed is:

1. The method of dispensing fluidized particulate materials from a plurality of holding vessels, which comprises:

(1) dispensing a first fluidized material from a first vessel through a first passage from said first vessel to a transport line;

(2) dispensing a second fluidized material from a second vessel through a second passage from said second vessel to said transport line for blending with said first material; and (3) controlling the flow rates of each said materials by selectively varying a portion of the cross-sectional area of the respective one of said first and second passages through which the material flows, the flow rate through each said passage being controllable independently of the flow rate through the other of said passages.

2. The method of dispensing a fluidized desulfurizing agent from a holding vessel through a passage to a transport line leading to a bath of molten ferrous metal, which method comprises:

controlling the flow rate of the fluidized stream by selectively varying a portion of the cross-sectional area of said passage in response to a variation from a prescribed set value in flow rate.

3. The method of desulfurizing molten ferrous metals, which comprises the steps of:

(1) feeding through a transport line a fluidized stream of a first desulfurizing agent during a first part of the desulfurizing cycle into the molten metal, and (2) feeding a fluidized stream of a second desulfurizing agent during a second part of the desulfurizing cycle into the molten metal through the same transport line as in step (1).

4. The method as described in claim 3, wherein:

said first desulfurizing agent is a mixture of at least two kinds of particulate materials, said second desulfurizing agent is a mixture of at least two kinds of particulate materials, and at least one of said mixtures is blended in said transport line.

5. The method as described in claim 4, wherein:

each of said mixtures is blended in said transport line, and one of the kinds of particulate materials forms a part of each of said mixtures.

6. The method as described in claim 5, wherein:

one of said mixtures is a blend of lime and magnesium, and the other of said mixtures is a blend of lime and graphite.

7. The method as described in claim 3, wherein:

at least one of said agents comprises a flow-aid material.

8. The method as described in claim 3, wherein:

said first desulfurizing agent is fed from a dispenser through a passage to said transport line, and the rate of flow of the fluidized stream bearing said first desulfurizing agent is varied during the desulfurizing cycle by selectively varying a portion of the cross-sectional area of said passage.

9. Apparatus for containing and feeding of particulate material, including a vessel for containing said material and including a first fluid stream source for fluidizing said material, a transport line including a second fluid stream source generating a fluid stream having a pressure less than the pressure of the fluid stream generated by said first fluid stream source, a discharge passage connecting said vessel with said line, weigh monitoring means for monitoring the flow of said material from said vessel, the improvement comprising:

actuatable valve means for controlling the flow of the fluidized material through said discharge passage, said valve means being actuatable to increase or decrease a cross-sectional area portion of said discharge passage to compensate for any deviation in flow rate from a preselected value as indicated by said weigh monitoring means.

10. Apparatus for dispensing and blending particulate materials in a fluidized stream, comprising:

transport line means for transporting said particulate materials and blending them in-line of said line and including a first fluid stream source generating therein a fluid stream at a first pressure;

a first dispensing unit including a vessel for containing a first material a fluid stream, having a pressure greater than said first pressure, fluidizing said first material, a discharge passage connecting said vessel with said line, and flow rate monitoring means monitoring the rate of flow of said first material from said vessel;

at least one additional dispensing unit, each including a vessel for containing particulate material, a fluid stream having a pressure greater than the fluid streams of each of the dispensing units upstream of the material flow in said transport line and greater than said first fluid stream a discharge passage connecting the vessel with said line, and flow rate monitoring means monitoring the rate of flow of the particulate material from the respective vessel; and actuatable valve means for each of said dispensing units, positioned in the respective discharge passage, for controlling the flow of the respective particulate material to said line independently of the rate of flow of the material passing from the other of said dispensing units.

11. A system for desulfurizing molten ferrous metal comprising:

a plurality of dispensers of particulate materials, each of said dispensers being arranged to dispense its material in a fluidized stream to a transport line for in-line mixing with material from other of said dispensers prior to injection into said molten ferrous metal;

each of said dispensers including passage means leading to said transport line, weight means monitoring the rate of flow of the fluidized stream, and actuatable valve means for said passage means and controlling the rate of flow therethrough by selectively varying the orifice opening of said valve means.

12. A system as described in claim 11, which comprises:

at least three dispensers for dispensing at least two different kinds of desulfurizing agents in fluidized particulate form.

13. A system as described in claim 11, wherein:

said actuatable valve means for each of said passage means is controllable to vary the rate of flow of the fluidized stream passing therethrough without adversely affecting the rate of flow the fluidized streams passing through the passage means of the other dispensing units.

14. The method as described in claim 7, wherein:

said first desulfurizing agent is a mixture of lime and said flow-aid material.

15. The method as described in claim 14, wherein:

said flow-aid material is graphite.

16. The method as described in claim 7, wherein:

said second desulfurizing agent is a mixture of magnesium and said flow-aid material.

17. The method as described in claim 16, wherein:

said flow-aid material is graphite.

18. A system as described in claim 11, wherein:

said actuable valve means includes a resilient sleeve body portion actuable by fluid pressure to vary the cross-sectional area of the passage therethrough.

19. A system as described in claim 18, wherein:

said resilient sleeve body portion defines a smooth bore passage in any throttled position.

20. A method as described in claim 2, wherein:

the step of varying a portion of the cross-sectional area of said passage is conducted by compressing and decompressing by fluid pressure a resilient sleeve body defining said portion.

* * * * *